United States Patent [19]

Marchaj

[11] 4,110,995

[45] Sep. 5, 1978

[54] SYSTEM FOR STORING LIQUIFIED GAS

[75] Inventor: Tadeusz J. Marchaj, Port Washington, N.Y.

[73] Assignee: Preload Technology, Inc., Garden City, N.Y.

[21] Appl. No.: 785,108

[22] Filed: Apr. 6, 1977

[51] Int. Cl.[2] ..... F17C 13/00

[52] U.S. Cl. ..... 62/50

[58] Field of Search ..... 62/50, 54

[56] References Cited

U.S. PATENT DOCUMENTS

| | | | |
|---|---|---|---|
| 2,550,886 | 5/1951 | Thompson | 62/50 X |
| 3,748,865 | 7/1973 | Laverman | 62/50 |

*Primary Examiner*—Allen M. Ostrager

*Attorney, Agent, or Firm*—Curtis, Morris & Safford

[57] ABSTRACT

A system for storing liquified gas, for example a tank to store liquified natural gas, wherein a vapor withdrawal piping system either within or outside the tank is provided to prevent the contact of expanding warm gas above a suspended insulated ceiling with the main body of liquified gas below the insulated ceiling due to pressure changes in the tank. In the proposed system a piping arrangement and vent manifold is used which includes a connection of the gas space above the suspended insulated ceiling in the storage tank with a vapor withdrawal line which is evacuating gas generated by heat influx into the main insulated body of gas stored in the tank.

14 Claims, 5 Drawing Figures

SYSTEM FOR STORING LIQUIFIED GAS

The present invention relates to cryogenic storage tanks and more particularly relates to venting systems for use with storage tanks for liquified gases.

The present needs for combustible fuels such as natural gas has far outstripped the ability of present gas reservoirs to supply natural gas especially at peak load demands. As a consequence, natural gas is being liquified for storage at very low temperatures in cryogenic storage tanks. Thus during low demand stages gas supplied from distribution networks or even supplied in liquified form in excess of that needed for immediate use is maintained in a liquified state and stored in a cold liquid state to be subsequently supplied at times of high demand use. The liquification process itself consumes large amounts of energy and thus it is important to try to minimize the energy required to maintain large supplies of gases in a liquid state. The present invention provides one way to minimize vaporization of stored liquified gas.

Typical cryogenic storage systems for natural gas include large insulated storage facilities, for example tanks having a diameter in excess of 200 feet and a height in excess of 100 feet and maintain the stored gas at temperatures sufficient to maintain the gases in a liquified state. Typical tanks of this type have storage capacities of about 100,000 cubic meters. In storing liquified natural gas the liquified gas is maintained at temperatures below about −258° F. These cryogenic storage facilities include suitable vents to maintain pressure equilibrium and blower systems which are selectively activated to maintain the desired pressure equilibrium and draw off vaporized gas for distribution.

In standard storage facilities for a gas such as liquified natural gas, the liquified gas is stored in a substantially cylindrical tank having an insulated ceiling suspended thereover with a domed reservoir above the suspended insulated ceiling. In most such systems there is a vent placed between the suspended insulated ceiling and the liquified gas storage reservoir to equalize the pressure between the gas spaces above and below the insulated ceiling. In addition, a gas withdrawal line is also provided which extends through the domed storage area into the liquified gas storage area to extract vaporized gas when pressure builds up in the storage tank above a predetermined maximum pressure due to heat influx or atmospheric pressure changes outside the tank.

Since the thermal insulation of such tanks cannot totally exclude heat influx to the liquified gas, the liquified gas is continuously being vaporized. As vaporized gas forms the pressure in the storage tank in the gas space above and below the insulated ceiling increases. When the pressure reaches a predetermined maximum level an exhaust blower is activated to withdraw vaporized gas until the pressure in the storage tank in the gas space above and below the insulated ceiling falls to a predetermined minimum pressure. The blower is then automatically shut off and the cycle is allowed to repeat and pressure again rises to the predetermined maximum allowable pressure. When the gas drawn off during operation of the blower is not immediately needed for distribution to gas users, the vaporized gas is stored in large gas storage tanks.

With the venting systems now in use on typical cryogenic storage tanks, relatively warm gas must pass through a vent opening in the insulated ceiling in the tank and flows over the cool liquid surface when an exhaust blower is activated to withdraw vaporized gas through the gas withdrawal line to lower the pressure to the predetermined value. Thus, this relatively warm gas passes from the domed storage area above the insulated ceiling into the liquified gas storage area and over the surface of the liquified gas as it is being withdrawn through the gas withdrawal line. Because this gas is warm, and may even be as warm as the ambient temperature surrounding the storage tank, such systems require that this relatively warm gas flow over the surface of the liquified gas. As a result, the relatively hot gas tends to warm the cold liquid surface causing further gas vaporization or boil off.

It is therefore an object of the present invention to provide a cryogenic storage system including a venting system to minimize the contact of hot gases with the liquified gas to minimize undesirable gas vaporization.

It is a still further object of the present invention to provide a venting system for cryogenic gas storage facilities which minimizes gas flow within a cryogenic storage tank to preclude unnecessary contact between hot gases and the relatively cool liquified gas.

These and other objects and advantages will become more readily apparent after consideration of the following specification and drawing.

According to one preferred embodiment of the present invention a venting system is provided for a cryogenic storage tank wherein the gas reservoir above the insulated ceiling of such a tank includes a gas outlet directly into the gas withdrawal line. The gas withdrawal line extends below the insulated ceiling to the liquified gas storage area and its other end flows directly to a blower which is activated to withdraw vaporized gas to control pressure build up within the storage tank.

Figure 1:
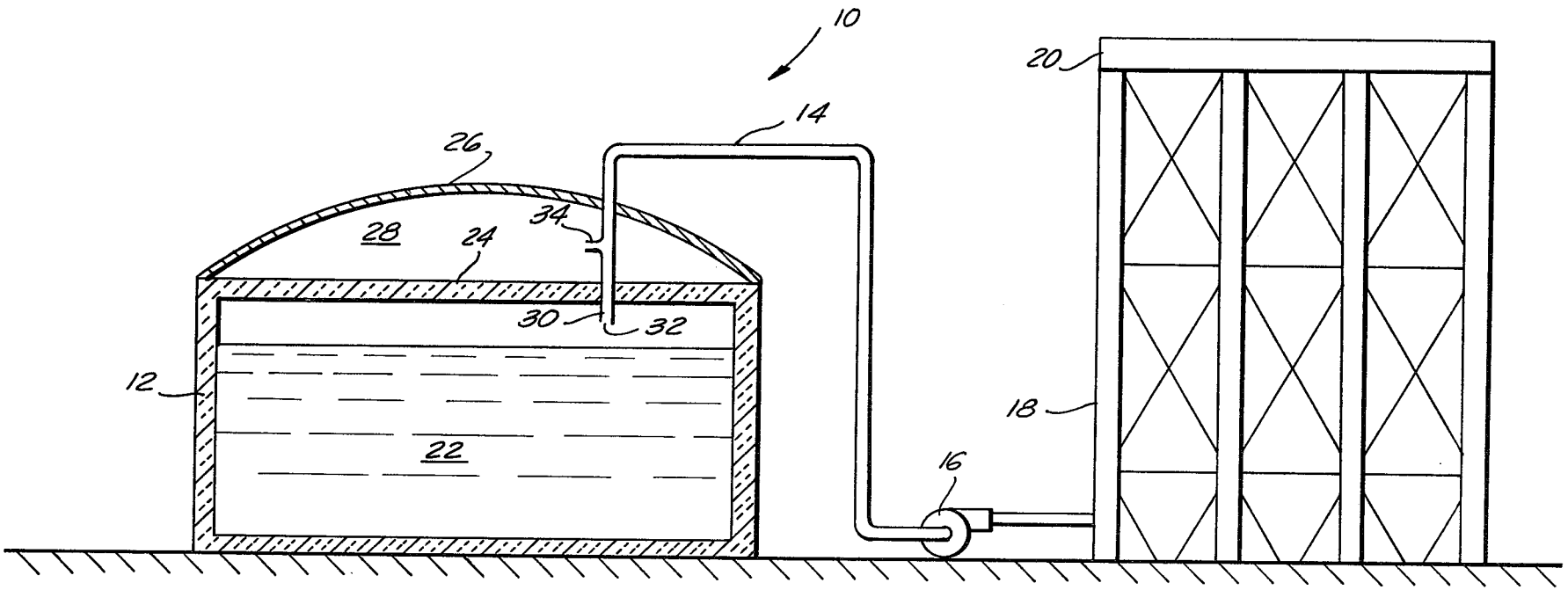
FIG. 1 is a diagrammatic representation of a liquified gas storage facility embodying the venting system of the present invention.

With reference to the drawing and particularly FIG. 1, there is shown a liquified gas storage system 10 which includes a liquified gas storage tank 12 provided with a vaporized gas withdrawal line 14, a suction pump or blower 16 and a vapor gas storage tank 18. The tank 18 may be any type of storage facility able to hold a vaporized gas and is preferrably that type of expandable storage tank which is telescopically expandable within a suitable steel super structure 20.

Tank 12 may be steel or reinforced concrete and generally includes a reservoir 22 for the storage of liquified gas, an insulated ceiling 24 over the liquified gas storage reservoir and a domed roof 26 which, with the insulated ceiling 24, defines a vaporized gas reservoir 28. As shown, the gas exhaust or withdrawal line 14 extends into the tank 12 and has its end 30 disposed through the insulated ceiling 24, within the reservoir 22 for the liquified gas. End 30 of line 14 has an opening 32 through which the vaporized gases may be exhausted from the liquified reservoir 22. In addition, line 14 is provided with an opening 34 disposed within the gas reservoir 28 above the insulated ceiling 24 so that there is direct communication between gas reservoir 28 and withdrawal line 14.

Figure 2:
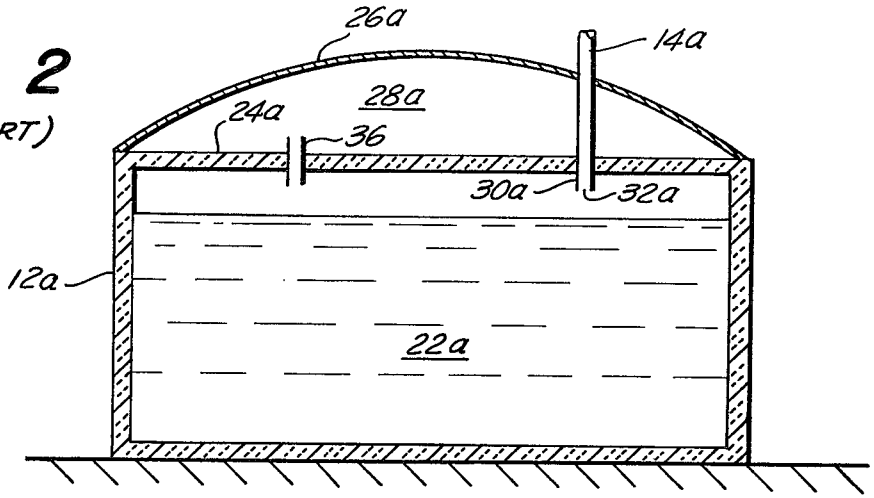
FIG. 2 (PRIOR ART)
FIG. 2 is a diagrammatic representation of a liquified gas storage facility showing the venting systems as used in the prior art.

In contradistinction to the venting system for a liquified gas storage tank of the present invention, there is shown diagrammatically in FIG. 2 a venting system typical to those currently employed in liquified gas storage tanks. FIG. 2 includes reference numerals which designate like parts as in FIG. 1 with the suffix "*a*". Thus it is seen that the basic tank structure remains the same with the sole exception being that most prior art liquified gas storage tanks of this type include a communicating vent 36 between the gas reservoir 28 and the liquified gas reservoir 22 and the vaporized gas exhaust line **14*a* has its end 30*a* and opening 32*a* communicating solely with the liquified gas reservoir 22*a*. Thus upon activation of an appropriate exhaust blower, gas is withdrawn through line 14*a* and as gas is withdrawn the warm gas from reservoir 28*a* passes back into reservoir 22*a* and flows over the surface of the liquified gas in reservoir 22*a***.

Liquified gas storage facilities such as those represented in FIGS. 1 and 2 also include appropriate pressure monitoring devices (not shown) which record pressure within the storage tanks. Such pressure recording devices are typically interconnected with the blower 16 and initiate activation of the blower when the sensed pressure has reached a predetermined maximum and also initiate deactivation of the blower when the pressure sensed has reached a predetermined minimum. It is evident that as gas is continuously vaporized, pressure within the storage tank will gradually build up. The rate of gas vaporization will be greatly effected by outside ambient conditions, for example, during times of high ambient heat the heat influx to the storage tank will be greater causing more gas to vaporize than during times of lower ambient temperature where the heat influx is not as great. Thus, when the pressure eventually builds up in the gas storage tanks to the predetermined maximum level, blower 16 is automatically activated to withdraw vaporized gas.

When blower 16 is operating in the environment shown in FIG. 1, the warmed vaporized gas in gas storage reservoir 28 is withdrawn through the withdrawal line 14 through the opening 34 disposed within the gas reservoir 28 above the insulated ceiling 24. In addition, cooler vaporized gas formed above the surface of liquified gas in reservoir 22 is also withdrawn through opening 22. With the arrangement shown in FIG. 1 the large volume of vaporized gas in reservoir 28 is withdrawn without passing over the surface of the liquified gas in reservoir 22 and, hence, unwanted heating of the surface of the liquified gas stored in reservoir 22 is avoided.

Such is not the case with the storage facility shown in FIG. 2. Here when the blower is activated, gas is withdrawn by line **14*a* through the opening 32*a*. As gas is withdrawn through line 14*a*, the gas stored in gas storage reservoir 28*a* flows through vent 36 passing over the surface of the liquified gas in reservoir 22*a* as it passes from the reservoir through the opening 32*a* into the withdrawal line 14*a*. Thus, the surface of the liquified gas stored in reservoir 22*a*** is subjected to the passage of relatively warmer gas over the surface resulting in a somewhat accelerated rate of vaporization during the gas withdrawal cycle.

Figure 3:
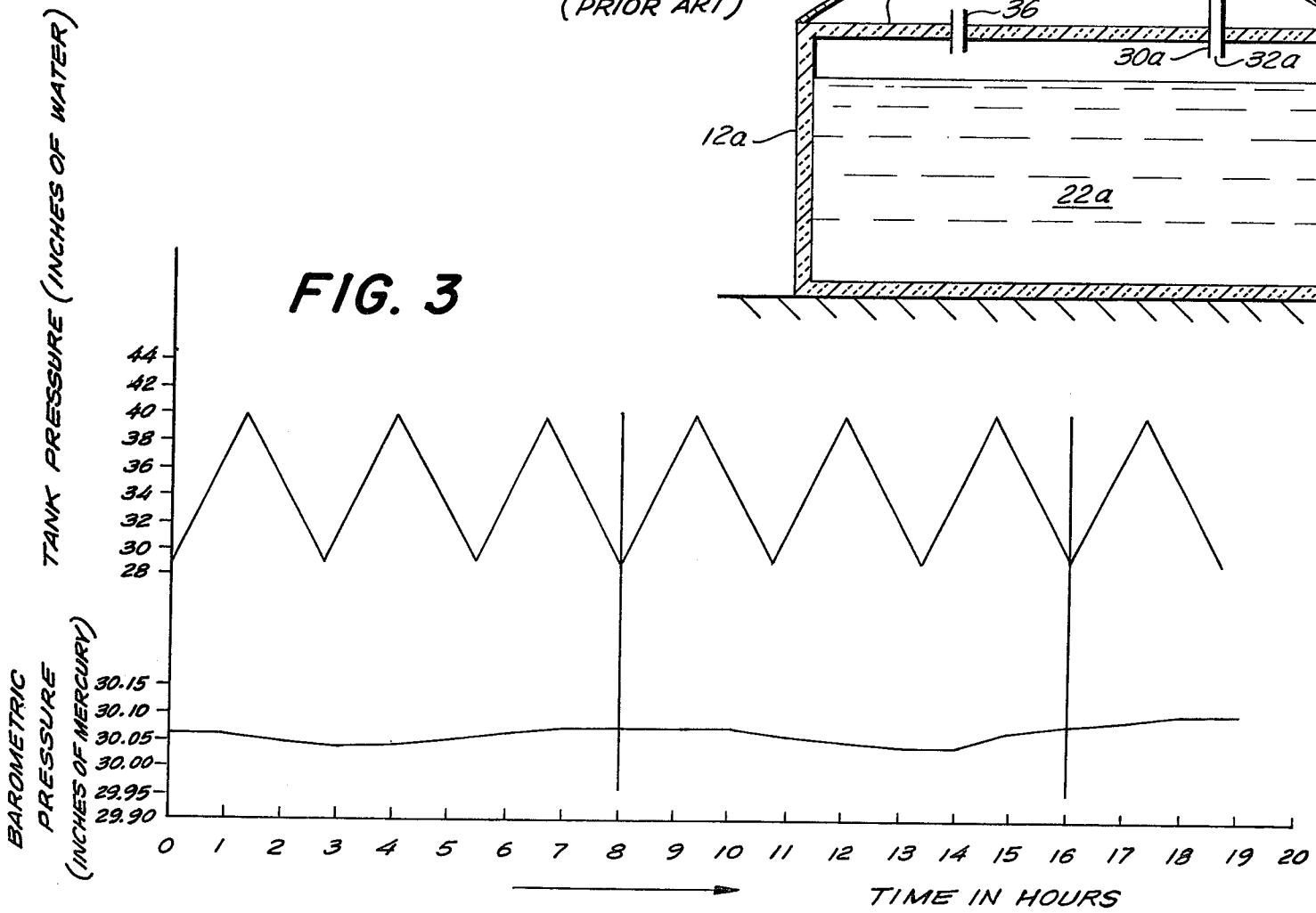
FIG. 3 is a graphical representation of pressure plotted against time taken from a representative liquified gas storage facility.

Reference is now made to FIG. 3 which graphically depicts pressure variation in a typical gas storage tank over a period of time.

As best seen in FIG. 3, ambient or barometric pressure, in inches of mercury, and internal tank pressure, in inches of water, are both plotted against time in hours and represent the indicated measured pressures over a period of time taken from a typical liquified gas storage tank, such as one depicted in FIG. 2, and used for the storage of liquified natural gas. As shown in the graph, for the tank analyzed, the minimum tank pressure at which the blower is deactivated was set for 29 inches of water and the maximum tank pressure, at which point the blower was activated, was set for about 40 inches of water. Thus, pressure within the storage tank was allowed to build up from 29 to 40 inches of water at which point the exhaust blower was activated and allowed to run until pressure in the tank fell back to 29 inches of water and the blower deactivated. Thus, during those periods where the upper graph in FIG. 3 had a positive slope the blower was in a deactive state and in those periods when the graph had a negative slope, the blower was operating and withdrawing vaporized gas from the storage tank.

The following analysis is made to compare the energy saving achievable with utilization of the venting system of the present invention (FIG. 1) as compared with a similar storage system using a conventional venting system (FIG. 2). This analysis is based on data observed at a liquified gas storage facility where the system had a storage capacity of 100,000 cubic meters, or 3,531,400 cubic feet. This is a typical sized system and yields a storage capacity of 630,000 barrels of liquified gas. Typically such a system will have a gas vapor storage area (**28*a***) of 744,600 cubic feet above the insulated ceiling for the storage of warmed vaporized gas. For purposes of this analysis an ambient temperature of 70° F. is assumed. This is consistent with standard practice in the design of such systems where calculations are made assuming a 70° F. ambient temperature. Hence, the vaporized gas in this volume will be assumed to be at ambient temperature of 70° F.

In addition, such systems have insulated walls of perlite or other pourous insulation material which trap a volume of vaporized gas. This creates an additional annular volume of vaporized gas storage capacity. In the typical system considered, the vaporized gas storage capacity in this annular storage space is 227,000 cubic feet. This volume of gas is in communication with the volume of gas above the insulated ceiling. The temperature gradient of the vaporized gas in this annular space is from −258° F. immediately adjacent the liquified gas within the tank to 70° F., ambient temperature, at the extreme peripheral surface adjacent the reenforced shell.

In typical cryogenic gas storage systems there is a third volume where vaporized gas is maintained. This is the volume above the surface of the body of liquified gas below the insulated ceiling. However, since the temperature of this vaporized gas is quite close to the temperature of the liquified gas, i.e., −258° F., for purposes of the present analysis this volume of gas need not be considered as it contributes an insignificant heat influx to the body of liquified gas which would tend to increase the rate of gas boil-off or vaporization.

In examining the available heat in the vaporized gas which can be transferred to the liquified gas during a cycle where the blower is activated and gas flows from above the ceiling into the space above the liquified gas and out the exhaust line (FIG. 2), the following calculations must be made. The first is a calculation of the volume of gas removed by the blower during blower activation. From the data shown, the internal tank pressure of the system examined went through a pressure change of 29 to 40 inches of water, or about 0.4 p.s.i. Thus, the predetermined range of pressure within the tank is 0.4 p.s.i. and each time the pressure is reduced from the predetermined maximum to the predetermined minimum. When the pressure in the system drops 0.4 p.s.i., a volume of the vaporized gas is removed by the action of the exhaust blower. This volume can be calculated from the formula $$\Delta V = (\Delta P/P_{min}) \cdot V$$

where, $\Delta V$ is the volume of gas removed $\Delta P$ is the change in pressure $P_{min}$ is the minimum absolute pressure of the tank, and $V$ is the volume of gas space in the tank.

Thus, for the system examined which shows the typical operating data shown in the graph in FIG. 3 the volume of gas extracted from the gas reservoir above the insulated ceiling during the cycle when the blower is operating is calculated as follows:

$$\Delta V_1 = (0.4/15.8) \cdot 744{,}600 = 18{,}850 \text{ ft.}^3/\text{cycle}$$

The volume of gas extracted from the annular gas reservoir around the body of liquified gas is calculated similarly as:

$$\Delta V_2 = (0.4/15.8) \cdot 227{,}000 = 5{,}747 \text{ ft.}^3/\text{cycle}$$

From the data shown in FIG. 3 it is evident that the blower is activated for a gas withdrawal cycle about once every three hours or eight times during a day. Thus the volume of gas necessary to be removed from such a tank during a day to maintain the predetermined maximum and minimum pressure is 150,800 cubic feet from the reservoir above the insulated ceiling and 45,976 cubic feet from the annular reservoir about the liquified body of gas. While typical observed values have been used, it is noted that a change in blower capacity would affect the number of cycles per day as would a different setting for the maximum and minimum predetermined pressure. However, such changes would not significantly effect the calculations for heat loss.

From the volume of vaporized gas extracted during a day due to the activation of the blower to maintain the predetermined pressure ranges, the heat available to be given off to the liquified body of gas can be calculated. This may be calculated using the formula:

$$Q = V \gamma C_p \Delta T$$

where $Q$ is the heat available in Btu's, $V$ is the volume of vaporized gas $\gamma$ is specific density $C_p$ is the specific heat of the gas, and $\Delta T$ is the temperature differential between the ambient temperature of the vaporized gas and the temperature of the liquified gas.

For natural gas (methane), $\gamma$ is 0.042 pounds per cubic foot and $C_p$ is 0.53 Btu's per pound. For the gas exhausted from the reservoir above the insulated ceiling the ambient temperature is considered to be 70° F. so that $\Delta T_1$ would be 328° and for the gas exhausted from the annular reservoir about the liquified body of gas the mean temperature is considered to be −100° F. so that $\Delta T_2$ would be 158°. Thus, the available heat $Q_1$ and $Q_2$, respectively, for the gas extracted from above the ceiling and from the annular reservoir may be calculated as follows:

$Q_1 = (150{,}800)\ (0.042)\ (0.53)\ (328)$ $Q_1 = (1{,}101{,}000$ Btu's/day; and $Q_2 = (45{,}976)\ (0.42)\ (0.53)\ (158)$ $Q_2 = 161{,}700$ Btu's/day Thus, the total available heat ($Q_1$ and $Q_2$) from the vaporized gas extracted from the two reservoirs of warmer vaporized gas in one day is 1,262,700 Btu's.

All cryogenic storage systems are designed to limit the maximum permissible amount of boil-off or vaporization of the liquified gas stored in the system. Thus, systems may be designed through calculating heat transfer parameters and selecting suitable types and thicknesses of insulating materials to limit the inherent boil-off which must occur. Typically, systems today are being designed to limit boil-off to between 0.03% and 0.05%. This is the designed boil-off rate. For the typical system under analysis having a storage capacity of 3,531,400 cubic feet of liquified gas a 0.03% boil-off rate would permit boil-off of 1060 cubic feet of liquified gas per day. From this volume of liquified gas which is vaporized the total heat influx to the system may be determined. This may be calculated using the formula:

$$Q = V \gamma \lambda$$

where $Q$ is the total heat input $V$ is the volume of liquified gas vaporized $\gamma$ is the density of the liquified gas (26 lbs./ft$^3$ for methane), and $\lambda$ is the latent heat of vaporization of the gas (220 Btu/lb. for methane).

Thus, the total heat influx to the system may be calculated as follows:

$$Q_t = (1060)\ (26)\ (220) = 6{,}063{,}200 \text{ Btu's.}$$

If the total heat influx per day is 6,063,200 Btu's and there is available from the warmer vaporized gas about 1,262,700 Btu's per day the significant aspect is how much of this approximately 1,000,000 Btu's available from vaporized warm gas in the system is transmitted to the liquified body of gas each time the exhaust blower is activated to withdraw vaporized gas across the surface of the cold liquified gas.

It is significant to note that from the standpoint of the designer for a liquified gas storage tank 1,262,700 Btu's per day are physically entering the insulating main body of the tank due to the passage of the warm gas over the surface of the liquified gas below the insulated ceiling.

A fair approximation of the available heat of the gas withdrawn when the blower is activated which passes over the liquified body of gas can be determined from the following calculations. This quantity of heat is available to be given off to the cool body of liquified gas to induce further vaporization.

First, in the tank analyzed the internal diameter of the liquid storage reservoir was 224 feet and, as liquid is usually maintained in the tank at a surface level of about three feet below the insulated ceiling, the volume available for the vaporized gas reservoir above the liquid surface and below the ceiling surface is 118,164 cubic feet. Thus, using the above formula to determine the volume of gas extracted from the reservoir during a cycle of blower operation the volume extracted would be:

$$\Delta V_3 = (P/P_{min}) \cdot V_3$$

$$\Delta V_3 = (0.4/15.8) \cdot 118{,}164 = 2991 \text{ ft.}^3\text{/cycle}$$

If it is assumed that during the blower activated cycle an equal proportion of gas will be extracted from each separate vaporized gas reservoir then $\Delta V_1$ (the volume of gas withdrawn from the hot gas reservoir above the ceiling) is 18,850 cubic feet per cycle, $\Delta V_2$ (the volume of gas withdrawn from the annular gas reservoir about the liquified body of gas) is 5,747 cubic feet per cycle; and $\Delta V_3$ (the volume of gas withdrawn from the cold gas reservoir above the liquid surface and below the insulated ceiling) is 2991 cubic feet per cycle.

If it is considered that the volume of gas withdrawn from $V_3$ is assumed to have a temperature of −258° F. and this is considered to be the reference base, then a calculation can be made as to the heat available to be given off by the volume of gas withdrawn from $V_1$ and $V_2$ above the reference temperature of −258° F. Thus, the gas withdrawn from $V_1$ has a weight of about 800 pounds (a volume of 18,850 cubic feet times the specific weight of methane, 0.0424 pounds per cubic feet, at 70° F.). The gas withdrawn from $V_2$ has a weight of about 362 pounds (a volume of 5,747 cubic feet times the specific weight of methane, 0.063 pounds per cubic feet at −100° F.). The gas withdrawn from $V_3$ has a weight of about 329 pounds (a volume of 2,991 cubic feet times the specific weight of methane, 0.11 pounds per cubic foot at −258° F.

One other volume of gas must also be considered and that is the volume of gas normally vaporized due to heat influx to the system. At a designed boil off rate of 0.03% this volume ($V_{HI}$) may be calculated by multiplying the volume of gas boiled off per hour due to heat influx (1060 ÷ 24) times the density of liquified methane (26 lbs/H.$^3$) times the time per cycle the blower is operating (for the system shown graphically in FIG. 3 this is 1.5 hours). Thus, the gas withdrawn due to heat influx would be:

$$V_{HI} = (1060/24) \cdot 26 \cdot 1.5 = 1722 \text{ lbs./cycle.}$$

The heat available from each of the volumes of gas withdrawn from $V_1$ and $V_2$ may be calculated as follows:

$$Q = MC_p\Delta T$$

where $Q$ is the available heat, $M$ is the weight of the gas, $C_p$ is the specific heat of the gas at its mean ambient temperature, and $\Delta T$ is the temperature difference between the temperature of the withdrawn gas and −258° F.

Thus $Q_1$, the heat available from the gas withdrawn from $V_1$ is:

$Q_1$ = (800) (0.53) (328) = 139,000 Btu's/cycle.

$Q_2$, the heat available from the gas withdrawn from $V_2$ is:

$Q_2$ = (362) (0.503) (158) = 28,770 Btu's/cycle.

The total available heat ($Q_1 + Q_2$) per cycle of blower operation from the gas withdrawn from volumes $V_1$ and $V_2$ which is above the reference point of the gas at −258° F. is 167,770 Btu's/cycle.

From this a calculation can be made as to the equilibrium temperature which should be reached if the $\Delta V_1$ at 70° F., $\Delta V_2$ at −100° F. and $\Delta V_3$ and $V_{HI}$ at −258° F. volumes of gas were mixed together using the formula:

$$\text{Btu's available over reference level} \div C_{P\,average} \div \text{total weight}$$

For the total weight data above, using an average $C_P$ for the gas mixture of 0.51 Btu's per pound ° F., the calculation becomes:

$$167{,}770 \div 0.51 \div (800 + 362 + 329 + 1722) = 102°$$

Thus, these four volumes of gas when mixed together should provide a change of 102° from the reference temperature of −258° F. or, in other words, the equilibrium temperature for the mixture of these three volumes of gas should be −156° F.

However, measured observation of a system as shown in FIG. 2 indicates that the average temperature of the gas withdrawn by the exhaust blower through line 14*a* is about −240° F., rather than −156° F. Thus, it is evident that not all of the heat available from the relatively warmer volumes of gas ($V_1$ and $V_2$) is utilized to warm the colder gas from $V_3$ and $V_{HI}$. This heat is available to be given off to the body of liquified gas and may be calculated as follows:

$$Q_T = MC_{P\,avg}\Delta T$$

where $Q_T$ is the heat remaining in the system per blower cycle, $M$ is the total weight of the gas from $V_1$, $V_2$ and $V_3$, $C_{P\,avg}$ is the average specific heat from the gases in $V_1$, $V_2$, $V_3$ and $V_{HI}$, and $\Delta T$ is the temperature differential between −156° F. and −240° F.

Thus, the heat remaining in the system is:

$$Q_T = (3213)\ (0.51)\ (84) = 137{,}645 \text{ Btu's/cycle.}$$

Based on eight cycles per day for blower activation, as seen in FIG. 3, the total heat available per day which remains in the system is 1,101,560 Btu's. This heat should be compared to the total heat available from the volumes of gas withdrawn calculated above ($Q_1 + Q_2$) or 1,262,700 Btu's and the desired design maximum influx of heat per day of 6,063,200 Btu's for a system having a capacity of 630,000 barrels of liquified gas.

While precise calculations of the actual heat flow into the liquified body of gas resulting from venting the warmer vaporized gas across the surface of the liquified gas (FIG. 2) is extremely difficult, it is safe to assume that the above calculations indicate that a high percentage of the heat available from the relatively warmer vaporized gas remains in the system and is absorbed by the liquified body of gas with the result that more liquified gas is vaporized or boiled off. Thus, during periods of operation when the storage system is meant to accumulate and store liquified gas for future use, the unnecessary boil off caused by venting systems as shown in FIG. 2 present additional unwanted boil off which results in greater energy usage to liquify the gas.

Considering that if the 1,101,560 Btu's per day of available heat remaining in the system was given off to the liquified body of gas this would result in the vaporization of 5,007 pounds of liquified gas (Btu ÷ latent heat of vaporization, 220 Btu per lb.). It is evident that even if all of this heat is not absorbed by the liquified body of gas but only a portion of it, the overall energy efficiency of cryogenic storage systems is appreciably increased by utilizing a venting system as shown in FIG. 1. With this system, the relatively warmer gas from the reservoir above the insulated ceiling and the annular reservoir about the liquified body of gas is withdrawn by blower 14 without being introduced into the insulated reservoir containing the liquified body of gas. Thus, there is no opportunity for any heat transfer from the warmer vaporized gas to the liquified body of gas.

Figure 4:
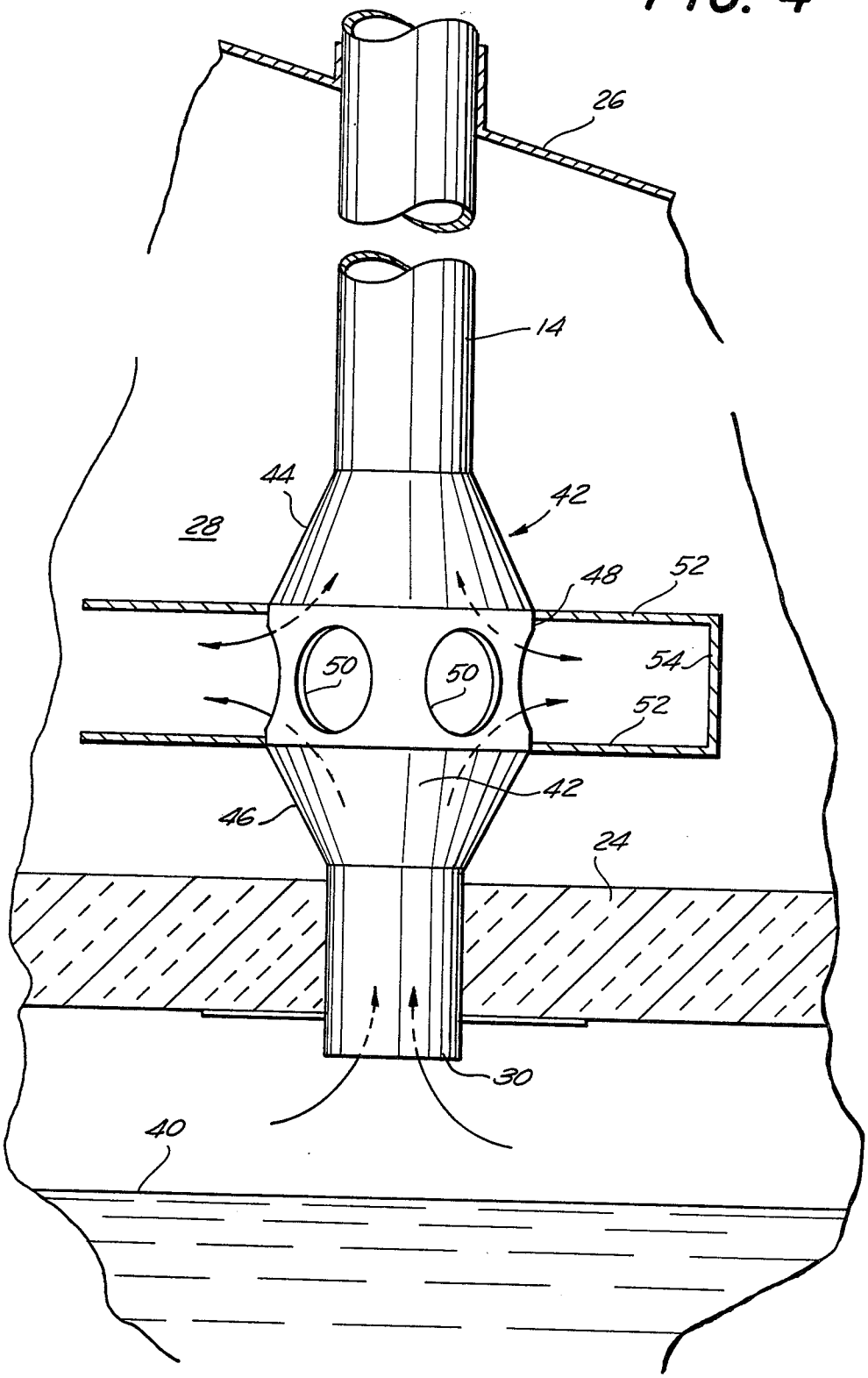
FIG. 4 is an elevational view showing a preferred embodiment for the construction of the vent manifold of the present invention.

Reference is now made to FIG. 4 where a preferred embodiment of a vent for a cryogenic storage system according to the present invention is shown. As shown, gas withdrawal line 14 extends through roof 26 and has its end 30 extending through insulated ceiling 24 in fluid communication with the vaporized gas above the liquid surface 40 and below ceiling 24.

Within reservoir 28 for the hot gas an intermediate communicating segment 42 is provided formed as opposed frustoconical segments 44 and 46 interconnected by a cylindrical segment 48. A plurality of openings 50 are provided within cylindrical segment 48 to afford fluid communication between reservoir 28 and the interior of the withdrawal line 14. In addition, vaporized gas may flow from the cold gas reservoir below ceiling 24 into the hot gas reservoir 28, as indicated by the arrows.

In order to direct the flow of gas into and out of openings 50, a pair of circular plate members 52 are preferably placed at each end of cylindrical segment 48. Plate members 52 extend radially outwardly from the peripheral surface of segment 48 and provide a flow pattern for gas passing through openings 50. Since withdrawal line 14 is typically oriented to one side in a storage system close to the roof segment 26, it is desirable to utilize a shield 54 which may extend between plate members 52 for a portion of the circumferential extent. Shield 52 is thus disposed over a portion of the cylindrical circumferential extent defined by the peripheral extent of plate members 52 closest to the interior surface of roof 26. In this manner, the flow of cold gas from the gas reservoir below insulated ceiling 24 is diverted away from a direct flow path impinging on the roof surface.

The shape of segments 44, 46 and 48 minimize the venturi nozzle effect and suction effect of gas flow from reservoir 28 by flow of gas in line 14 when blower 16 is activated. The cold gas from the insulated space in the main storage space of the tank can enter the hot gas reservoir when the blower is not activated.

Figure 5:
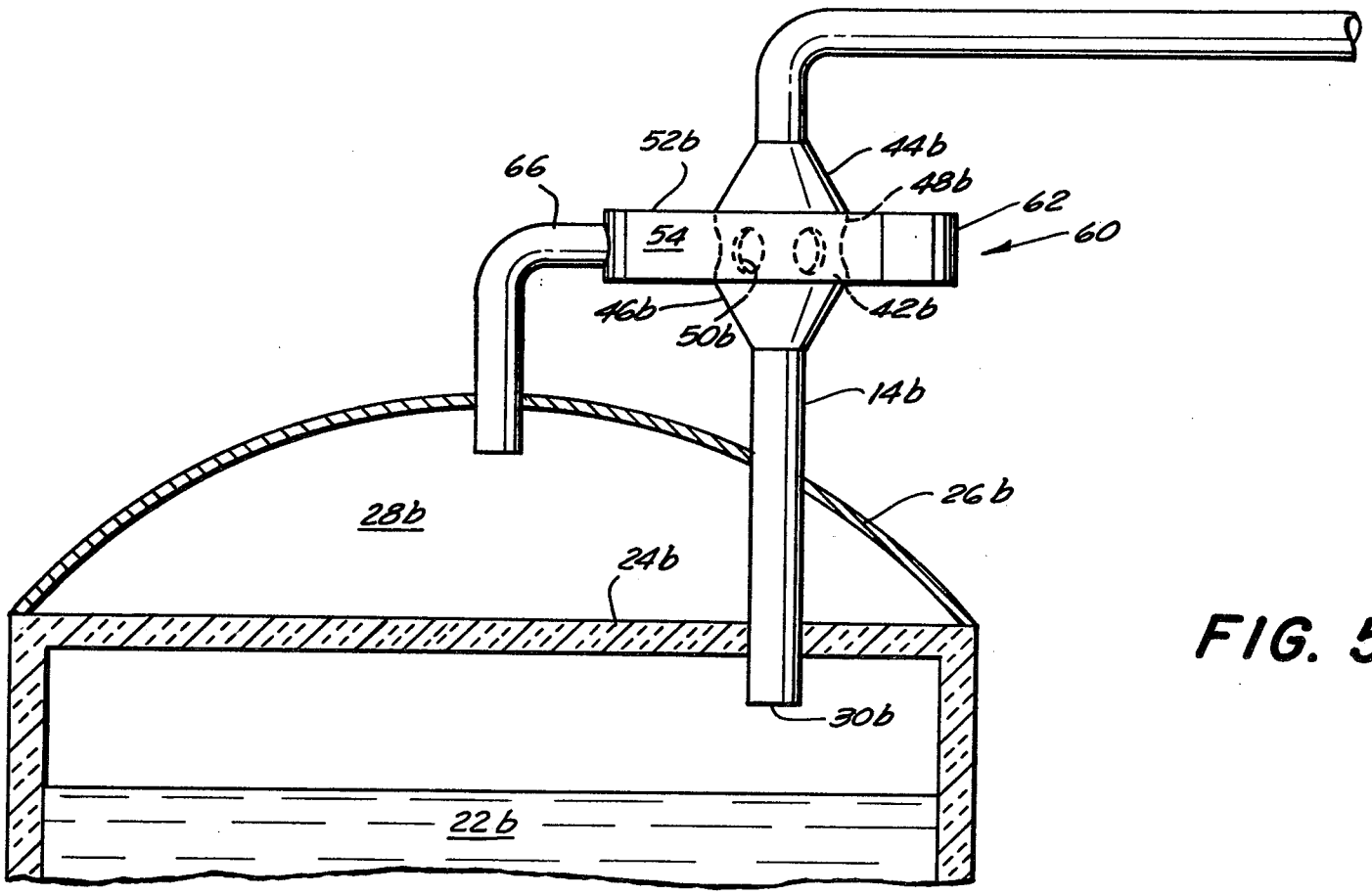
FIG. 5 is a diagrammatic representation of an alternative arrangement for the venting system of the present invention.

An alternate embodiment of the venting system of the present invention is shown in FIG. 5. In this embodiment the bypass venting housing is placed exterior the roof surface, if desired, for ease of construction or for ease in adapting cryogenic storage systems of the type shown in FIG. 2 to incorporate the improved venting concept of the present invention.

In this embodiment the withdrawal line **14*b* extends through the roof 26*b* of a liquified gas storage tank and through the insulated ceiling 24*b* so that the opening 30*b* of the withdrawal line is disposed below the insulated ceiling and above the surface of the liquified gas in the reservoir 22*b***.

A vent assembly 60 is disposed above the roof surface **26*b* and includes an intermediate communicating segment 42*b* disposed within gas withdrawal line 14*b*. The communicating segment 42*b* is formed in a similar manner to the intercommunicating segment 42 (FIG. 4) and includes opposed frusto-conical segments 44*b* and 46*b* interconnected by a cylindrical segment 48*b* provided with a plurality of openings 50*b* to afford fluid communication between the interior and exterior of the fluid withdrawal line 14*b*. Upper and lower radially extending plate members 52*b* are also provided connected by a peripherally extending wall segment 62 to define a plenum chamber 64 about the cylindrical segment 48*b* and the openings 50*b* therein. A vent line 66 is disposed between the plenum chamber 64 and gas reservoir 28*b* above the insulated ceiling 24*b*** in the cryogenic storage tank.

The arrangement shown in FIG. 5, with the blower in the system in an inactive state, affords pressure equalization within the storage tank occurs with gas from below the insulated ceiling passing up the gas withdrawal line **14*b* out openings 50*b* into plenum chamber 64 and into gas reservoir 28*b* above the insulated ceiling. When the blower is operating, hot gas in reservoir 28*b* is withdrawn by action of the blower through line 66 into plenum chamber 64 through the openings 50*b* and out line 14*b* to the blower for disposition. Thus, it is seen that the arrangement shown in FIG. 5 accomplishes the same result as the arrangement shown in FIG. 4 in order to preclude passage of the hot gas into the main body of liquified gas in reservoir 22*b***.

The arrangement shown in FIG. 5 is also adaptable to existing cryogenic storage tanks without requiring entry into the tank for a construction similar to that shown in FIG. 4. With the addition of the arrangement shown in FIG. 5 to existing tanks, although these systems would still have a direct vent from the reservoir below the insulated ceiling to the reservoir above the insulated ceiling, withdrawal of gas would be, to a significant extent, predominantly from the reservoir above the insulated ceiling. Gas withdrawn from this reservoir which flows back into the insulated reservoir would be at a minimum to achieve a significant heat savings and minimize undesired additional boil off.

It is thus seen that the present invention provides a method and apparatus for exhausting vaporized gas from a cryogenic storage system which minimizes vaporization or boil off by minimizing the contact of hot vaporized gas with the liquified body of gas.

I claim:

1. In a cryogenic storage system for storing a body of liquified gas having an insulated reservoir for storing a body of liquified gas, a reservoir for gas vaporized from said body of liquified gas isolated from said insulated reservoir and a vaporized gas withdrawal line for selective removal of vaporized gas from the system, a method for venting and withdrawing vaporized gas from the system comprising: limiting the passage of vaporized gas so vaporized gas flows only from said insulated reservoir to said vaporized gas reservoir, and limiting the flow of vaporized gas when gas is withdrawn from the system to preclude flow of vaporized gas from said vaporized gas reservoir to said insulated reservoir.

2. The method as defined in claim 1 wherein said step of limiting the flow of vaporized gas when gas is withdrawn comprises directing vaporized gas stored in said vaporized gas reservoir directly into said gas withdrawal line so as to preclude contact of said vaporized gas in said vaporized gas reservoir with said body of liquified gas in said insulated reservoir.

3. The method as defined in claim 2 including the step of interconnecting a selectively operable exhaust blower means in communication with said gas withdrawal line to exhaust vaporized gas from said system when said blower means is activated.

4. The method as defined in claim 3 including the step of measuring internal pressure within said system and operating said blower means when internal pressure has risen to a predetermined maximum and deactivating said blower means after internal pressure has fallen to a predetermined minimum.

5. In a cryogenic storage system for storing a body of liquified gas having an insulated reservoir for the storage of liquified gas, a reservoir for gas vaporized from said body of liquified gas isolated from said insulated reservoir and a vaporized gas withdrawal line for selective removal of vaporized gas from the system, the improvement comprising means within said system providing communicative means between said gas withdrawal line and said reservoir for vaporized gas to exhaust gas from said reservoir for vaporized gas directly into said gas withdrawal line without passing said vaporized gas into said insulated reservoir.

6. A system as defined in claim 5 including vent means between said insulated reservoir and said reservoir for vaporized gas to permit flow of vaporized gas only from said insulated reservoir to said reservoir for vaporized gas.

7. A system as defined in claim 6 wherein said vent means includes said gas withdrawal line communicating with said insulated reservoir and includes an intermediate communicating segment within said withdrawal line in fluid communication with said reservoir for storage of vaporized gas.

8. A system as defined in claim 7 wherein said intermediate communicating segment includes opposed frusto-conical segments having facing wider portions interconnected by a cylindrical segment provided with a plurality of access openings therein to permit gas flow into and out of said communicating segment and said withdrawal line.

9. A system as defined in claim 8 wherein said intermediate communicating segment includes spaced radially extending plate members positioned to include said plurality of access openings therebetween to define a flow path for gas flow into and out of said access openings.

10. A system as defined in claim 9 including an interconnecting plate member positioned radially spaced outwardly from said intermediate communicating segment between said extending plate members and extending over a portion of the peripheral extent of said plate members.

11. In a cryogenic storage system for storing a body of liquified gas having an insulated reservoir for the storage of liquified gas, a reservoir for gas vaporized from said body of liquified gas isolated from said insulated reservoir and a vaporized gas withdrawal line for selective removal of vaporized gas from the system, the improvement comprising means associated with said withdrawal line and said reservoir for vaporized gas to provide gas communication between said reservoir for vaporized gas and said withdrawal line along a path for gas flow which bypasses said insulated reservoir.

12. A system as defined in claim 11 wherein said means to provide gas communication includes vent means to provide a gas flow path from said insulated reservoir to said reservoir for vaporized gas.

13. A system as defined in claim 12 wherein said means to provide gas communication comprises an intermediate communicating segment disposed within said withdrawal line exterior said storage system comprising opposed frusto-conical segments having facing wider portions interconnected by a cylindrical segment provided with a plurality of access openings therein to permit gas flow into and out of said communicating segment and means associated with said communicating system to provide a gas flow path from said communicating segment to said reservoir for vaporized gas.

14. A system as defined in claim 13 wherein said means to provide a gas flow path from said communicating segment to said reservoir for vaporized gas includes means defining a chamber about said access openings in said communicating segment and a gas communicating line interconnecting said chamber and said reservoir for vaporized gas.

* * * * *